United States Patent [19]

Lorber et al.

[11] 4,017,344

[45] Apr. 12, 1977

[54] MAGNETICALLY ENHANCED COAXIAL CABLE WITH IMPROVED TIME DELAY CHARACTERISTICS

[76] Inventors: Harold Lorber, 3225 Burn Brae Drive, Dresher, Pa. 19025; Irving Duboff, 1513 Woodland Road, West Chester, Pa. 18015

[22] Filed: May 23, 1975

[21] Appl. No.: 580,231

Related U.S. Application Data

[62] Division of Ser. No. 338,335, March 5, 1973, Pat. No. 3,886,506.

[52] U.S. Cl. ..... 156/52; 174/28; 174/126 CP; 333/96

[51] Int. Cl.[2] ..... H01B 13/06; H01B 13/22

[58] Field of Search ..... 333/96, 24.1; 29/600, 29/624; 156/47, 50–53, 55; 174/28, 126 CP; 340/174 PW, 174 TL; 324/43 R

[56] References Cited

UNITED STATES PATENTS

| | | | |
|---|---|---|---|
| 3,320,554 | 5/1967 | Wieder | 333/24.1 |
| 3,460,114 | 8/1969 | Chow | 340/174 TL |
| 3,657,641 | 4/1972 | Kardashian | 324/43 R |

OTHER PUBLICATIONS

Kehler et al., *Susceptibility & Ripple Studies in Cylindrical Films,* Jrnl. of Applied Physics, vol. 41, No. 3, Mar. 1, 1970, pp. 1346, 1347.

*Primary Examiner*—Paul L. Gensler
*Attorney, Agent, or Firm*—John B. Sowell

[57] ABSTRACT

The method of making a magnetically enhanced coaxial cable of the type having a center conductor, a dielectric spacer around the center conductor and a conductive shield around the dielectric spacer wherein said magnetic enhancement comprises circumferentially oriented uniaxial anisotrophic magnetic material having high conductivity and high permeability adapted to transmit wave energy and conventional current without being switched or reoriented. The magnetic enhancement provides an increase inductance and current carrying capacity without corresponding increases in time delay and other losses associated with magnetic loading.

9 Claims, 6 Drawing Figures

MAGNETICALLY ENHANCED COAXIAL CABLE WITH IMPROVED TIME DELAY CHARACTERISTICS

This is a division of application Ser. No. 338,335 filed on Mar. 5, 1973, now U.S. Pat. no. 3,886,506.

BACKGROUND OF THE INVENTION

This invention relates to coaxial transmission cables for use in transmission of both conventional current and electromagnetic waves.

More particularly, this invention relates to a magnetically loaded transmission cable which has greater current carrying capabilities than previously known cables of equal size or alternatively the novel magnetically loaded transmission cable is capable of being made smaller in size and volume than previously known cables without causing increases in losses or time delay normally accompanying magnetic loading.

Heretofore, it was known that magnetically loading a coaxial transmission cable would increase the inductance of the line. As the inductance increases, characteristic impedance and the time delay increases in conventional coaxial cables. Heretofore, it was desirable to increase the inductance by magnetic loading to decrease attenuation even though such magnetic loading introduced hysteresis and eddy current losses and caused increases in time delay.

Magnetic loading materials spaced in the dielectric of coaxial cables are described in U.S. Pats. Nos. 2,787,656; 2,929,034 and 2,727,945. These and other magnetic loading teaching are generally concerned with high resistance and high permeability ferrites which by their structural nature are large or relatively thick and are not applicable for use for microminiature cables for solid loaded center conductors or as coatings on non loaded center conductors. Thin film magnetically coated center conductors have been employed in plated wire memory planes such as those shown in U.S. Pat. No. 3,460,114, however, such rigid planes are generally concerned with reducing the characteristic impedance of an unshielded insulated memory wire. Plated memory wires are not uniformly shielded and are designed to switch from one state to another by coupling magnetic fields.

There has long been a need to reduce the size and weight of flexible coaxial cables without increasing time delay or losses. Coaxial cable for high speed computers and communications equipment require minimized time delays as well as miniaturization. Major computer manufacturers and coaxial cable manufacturers have recognized this need but have not miniaturized conventional coaxial cables by magnetic loading because of the increase in time delay and losses. Since computer advances are often accomplished through faster operations embodied in solid state devices, the need for faster propagation of electrical pulse energy has become almost as important as miniaturization of the circuitry.

BRIEF SUMMARY OF THE INVENTION

The present invention provides a method for making flexible coaxial cable having increased characteristic impedance achieved through magnetic loading which increases the inductive reactance and decreases the attenuation, however, the increase in inductive reactance is not accompanied by the usual expected increase in time delay. The methods employed to achieve the desired magnetic loading do not increase the eddy current and hysteresis losses or other losses which would detract from the use of the novel flexible coaxial cable as a miniaturized high frequency coaxial transmission cable.

A principal object of this invention is to reduce the size and weight of a coaxial cable without changing its characteristic impedance or increasing losses and time delay.

Another object of the present invention is to minimize time delay of coaxial cables while increasing the inductive reactance.

Another object of the present invention is to provide a method for producing a series of microminiature coaxial cables having new and desirable attenuation and time delay characteristics.

Another object of the present invention is to provide means for conducting larger amounts of conventional current without increasing the overall size of a coaxial cable.

Accordingly, there is provided a conventional coaxial cable structure comprising a center conductor and an outer shield separated by a dielectric spacer. The center conductor is further provided with circumferentially oriented uniaxial anisotropic magnetic material which provides a large increase in permeability. The overall outside diameter of the loaded center conductor cable may be decreased without changing the characteristic impedance or increasing time delay of high frequency pulses. Means supplying electrical energy to the center conductor are preferably limited to very high frequency pulses whose operational level and direction prevents switching of the magnetic orientation, thus, permitting the minimum delay time in wave propagation. These and other features of the present invention will be set forth in greater detail in the following description.

DESCRIPTION OF THE PREFERRED EMBODIMENT

Figure 1:
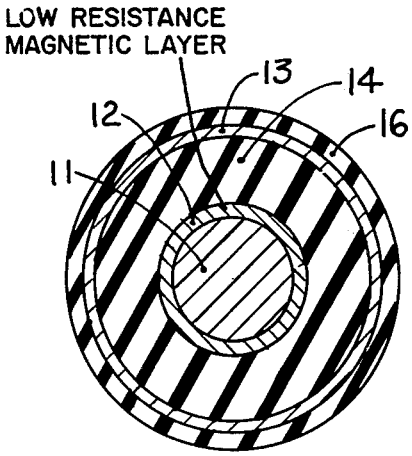
FIG. 1 is a transverse sectional view of a miniaturized coaxial cable constructed in accordance with teachings of this invention.
Figure 2:
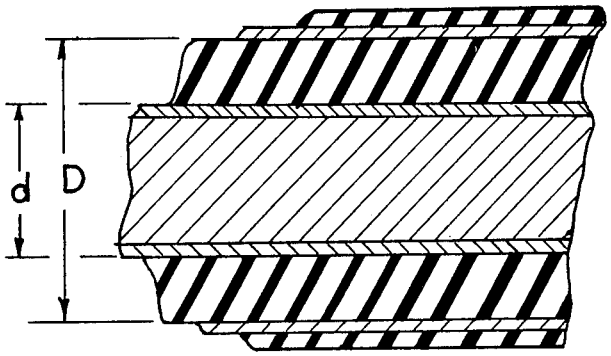
FIG. 2 is a longitudinal section view of a miniaturized coaxial cable constructed in accordance with the teachings of this invention.

FIGS. 1 and 2 show a coaxial cable constructed in accordance with a preferred embodiment of this invention. The cable shown comprises a center conductor 11 of conductive material such as copper, copper-beryllium or other high strength conductive alloys. A thin conductive coating of magnetic material 12 is conductively attached to the center conductor 11 directly or to an extremely thin base conductive layer (not shown) on the center conductor 11. As will be explained hereinafter the positions of conductors 11 and 12 may be reversed.

The thin layer of magnetic material 12 is preferably circumferentially oriented with an easy magnetization axis transverse to the direction of wave propagation. Conversely, the hard magnetization axis is axially aligned with the direction of wave propagation to assure the preferred mode of operation of the invention. It has been found that uniaxial anisotropic Ni—Fe films 500 A to approximately 15,000 A thick provide a desirable oriented film for the preferred embodiments hereinafter explained.

A preferred method of providing the desired uniaxial anisotropic orientation is to plate the desired magnetic layer 12 onto the center conductor 11 in the presence of a strong circumferentially oriented magnetic field such as that which occurs when a strong d.c. conduction current is passed through the center conductor 11. The center conductor 11 may be annealed and then placed in the presence of strong circumferential field while the magnetic layer 12 is cooled from above its recrystallization temperature. Reheating and reorienting may be necessary when stress relieving a plated center conductor 11 or when hot processes are employed to attach the dielectric spacer 14. Dielectric 14 such as fluorinated Ethylene Propylene (FEP Teflon) melt extrudes on the center conductor at 650° – 780° F. Ethylene and Tetrafluorothylene (ETSE) or (TEFZEL) melts extrudes at 630° –750° F. Polyethylene melt extrudes at 300° – 400° F. Polypropylene melt extrudes at 350°–400° F. Polytetrafluoroethylene (PFTE) is ram cold extruded as a powder or paste with a solvent such as naphtha at low temperatures, the vapor removed at close to 250° F but is sintered at temperatures between 700° – 1000° F. The curie point of nickel is 675° F (the recrystallization point is lower), thus, the magnetic orientation and anisotrophy of the magnetic layer or loaded center conductor can be affected by the application of the dielectric layer 14.

A dielectric spacer 14 surrounds the magnetically coated center conductor 11 and a continuous conductive shield 13 surrounds the dielectric spacer 14. The shield 13 may be protected by an insulating layer or jacket 16.

Figure 3:
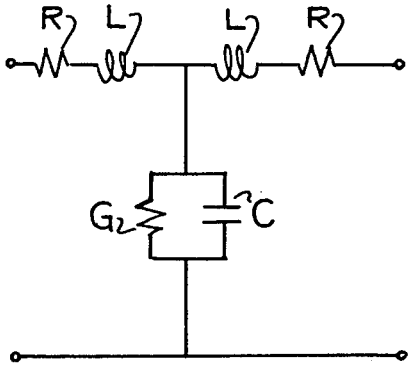
FIG. 3 PRIOR ART
FIG. 3 is a simplified equivalent network circuit of a conventional coaxial cable.

It was discovered that the novel coaxial transmission cable did not operate in a manner to be expected by the addition of a magnetic loading material. The operating characteristics of the coaxial cable shown in FIGS. 1 and 2, both with and without magnetic loading materials may be defined by equivalent circuit formulas. A simplified equivalent network circuit for a conventional coaxial cable is shown in FIG. 3.

The series inductance L of an equivalent tee section coaxial transmission cable has been defined by $$L = \frac{\mu}{2\pi} \log D/d \qquad (1)$$

the shunt capacity C by $$\frac{1}{C} = \frac{1}{2\pi\epsilon} \log D/d \qquad (2)$$

the characteristic impedance Z by $$Z = \sqrt{\frac{L}{C}} = \frac{1}{2\pi}\sqrt{\frac{\mu}{\epsilon}} \log D/d \qquad (3)$$

the attenuation $\alpha$ by $$\alpha = \frac{R}{2}\sqrt{\frac{C}{L}} + \frac{G}{2}\sqrt{\frac{L}{C}} \qquad (4)$$

and the time delay T by $$T = \sqrt{LC} = \sqrt{\frac{\mu}{\epsilon}} \qquad (5)$$

where $\mu$ is the permeability of the dielectric, $\epsilon$ is the dielectric constant of the dielectric spacer, D is the inside diameter of the outer shield, $d$ is the outside diameter of the center conductor, R is the series resistance, C is the shunt capacitance and G is the shunt conductance.

The values in a standard original coaxial cable may be designated by sub "o" notation and values of prior art magnetically loaded coaxial cable may be designated by sub-"r" notations. Adding a very thin layer of magnetic material to the center conductor will increase the inductance $L_o$ to $L_r$ without measurably changing the spacing of the elements, the dielectric constant $\epsilon$ of the dielectric spacer 14 or the shunt capacitance C.

Formula (1) indicates that the inductance $L_r$ increases with an increase in resultant permeability $\mu_r$. Formula (2) indicates that the shunt capacity C is inversely proportional to D/d and directly proportional to the dielectric constant $\epsilon$. Formula (3) indicates that characteristic impedance $Z_r$ increases with an increase in inductance $L_r$. Formula (4) indicates that attenuation $\alpha_r$ decreases with an increase in inductance $L_r$ as the first term of formula (4) is large compared to the second term. Formula (5) indicates that time delay $T_r$ increases with an increase in inductance $L_r$ and effective permeability $\mu_r$.

A piece of standard construction coaxial cable having an impedance of 17 ohms was found to have a time delay $T_o$ of approximately 1.5 nanoseconds per foot. An increase of the resultant $\mu_r$ over $\mu_o$ by a factor of five would ordinarily increase both $Z_r$ and $T_r$, by the square root of five. Applicants have been able to so increase $Z_r$ without a corresponding increase in $T_r$.

In one series of tests the time delay of a 17 ohm coaxial cable appeared to be unchanged or reduced even though the inductance $L_r$ and characteristic impedance $Z_r$ were increased. A piece of the novel coaxial cable was altered to change the circumferentially oriented easy axis of the uniaxial anisotropic layer of thin magnetic material 12 to a partially isotropic layer. The time delay $T_r$ of the altered sample almost doubled. For comparison purposes, it has been established by test and calculations that a seventeen ohm coaxial cable can be increased to 50 ohms by magnetically loading the cable. Ordinarily magnetic loading would increase the time delay from 1.5 nanoseconds per foot, to over 4.0 nanoseconds per foot. The time delay of the magnetically enhanced cable constructed according to the present invention remained at approximately 1.5 nanoseconds per foot, however, when the same coated center conductor was partially annealed to partially destroy the desired magnetic orientation the time delay increased to over 2.5 nanoseconds per foot. Similar desirable low time delay results were obtained with oriented solid magnetic center conductor wire 11 with and without conductive layers 12.

It was discovered that 80% Ni — 20% Fe Permalloy plated on copper beryllium center conductors to a thickness of 8,000 A to 10,000 A in a manner which provides a circumferentially oriented magnetic easy axis, when made into the novel coaxial cable, increased the characteristic impedance $Z_r$ without an appreciable increase in time delay $T_r$ over $T_o$. Initial results indicate that the time delay may be as low as or below that obtained for coaxial cables without magnetic loading.

The properties of uniaxial anisotropic material may be enhanced by first coating a flash layer of copper on the center conductor. It is believed that the copper or other conductive undercoat aids in maintaining uniform anisotropy and masks structural defects in the center conductor. Thin films 500 A to about 15,000A thick have been made which have easy axis and hard axis orientation. It may be desirable as in plated wire memories, to restrict the magnetostriction effects to a minimum as usually occurs in Permalloy films having approximately 80% nickel. Films which have the above described circumferential easy axis orientation may be made by plating, vacuum deposition and sputtering in the presence of a circumferentially oriented magnetic field. Other film techniques such as cladding, rolling, evaporation, drawing, and chemical deposition and suspension deposition may require post operative annealing in an induced magnetic field.

Nickel iron alloys and other conductive magnetic materials which have crystalline grain structure may be coated on the center conductor and then cold drawn so as to create a preferred desired oriented magnetic field.

The plated thin films were deposited or treated in a magnetic field so that the preferred orientation was circumferential and the film displayed high anisotropy. The clad and/or drawn nickel iron wires, known to have a crystalline grain structure, were oriented mechanically through the process of cold drawing. The easy axis orientation is caused by the elongation of the grain crystals which remain elongated if not overheated. The drawn wires may be annealed without destroying the high anisotropy developed mechanically, thus, drawn wire may be more stable for commercial purposes. Solid magnetic drawn wires display the desirable permeability increase but are not as conductive as magnetically clad wires but can be enhanced by conductive coatings at the outer layer 12. While the special crystal orientation is not well understood it is presumed that an apparent effective internal magnetic field is present as a result of interaction of grain crystals and the high effective internal field. This magnetic field is present at the wall of the center conductors which form the wave guide. There appears to be a faster phase change as a result of the oriented magnetic field and the time delay is decreased (increase in phase velocity).

Another feature of the present invention requires that the thin layer of magnetic material 12 be relatively conductive so that the radial electrical field E at the boundary of the center conductor be continuous as will be explained. Permalloy type thin films are considered to be high permeability, low resistance films, whereas ceramic ferrites are considered to be high resistance, high permeability materials which do not conduct conventional current.

The dielectric material 14 can be any low loss dielectric preferably having a dielectric constant in the range of $\epsilon = 1.2$ to 3.5. The dielectric constant for air is 1.0 and for foamed plastics may be as low as 1.3, however, Teflon which is desirable for many uses is 2.1. Materials known to be used in coaxial cables such as Mylar, polyethylene, polypropylene and other polyolefins are also useful in the present novel cable. The shield 13 is made from a conductor which has low loss at operating frequencies. Copper braid is sometimes employed because it is known to act as a closed shield below 1000 megahertz. Solid copper in the form of film, wire foil or foil supported on insulating tapes may be employed. It is desirable that the shield 13 be conductive and at least twice the skin depth thickness at the upper frequency of operation as is the case for coaxial cable outer shields.

The outer insulation layer 16 may be any typical electrical insulation and may be applied as a tape either with or without the shield 13.

Figure 4:
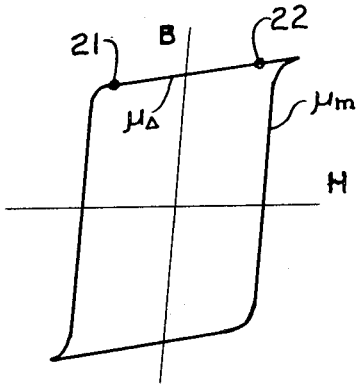
FIG. 4 is a typical B vs. H curve for square loop high permeability magnetic material.

High permeability materials usually have high eddy current and hysteresis losses. Ferrites have been employed as magnetic loading materials in coaxial cables because the B vs H loop is narrow indicating that low hysteresis losses are to be expected. FIG. 4 illustrates an open B vs H loop of the type obtained with thin films or Permalloy materials, where B is the flux density and H is the magnetizing force intensity. The permeability $\mu$ of a material is defined as $\mu = B/H$. The slope of the curve is substantially horizontal in the saturation region, and substantially vertical in the unsaturated region. It can be seen that the incremental permeability $\mu\Delta$ will increase if the magnetizing force H switches the saturation region from negative to positive saturation. The incremental permeability $\mu\,\Delta$ of uniaxial anisotropic films may be held substantially constant at very small values (about 5 gauss per oersted), thus it is possible to transmit pulse power in the novel coaxial transmission cable by remaining on a horizontal portion $\mu\,\Delta$ of the B vs H curve, such as operating between point 21 and 22 on the curve without incurring time delay increases as would be incurred if operating at maximum permeability.

It has been found that 75 ohm novel transmission cable may be operated in a conventional mode with very high frequency pulse power surges up to three fourths of a watt without switching the magnetic orientation or incurring hysteresis or eddy current losses. The novel coaxial cables may be used without encountering undesirable effects.

If the aforementioned formulas (1), (2) and (3) are combined it can be shown that $$Z = \sqrt{\frac{L}{C}} \quad \text{and}$$

$$Z = \frac{377}{2\pi}\sqrt{\frac{\mu}{\epsilon}}\ \ln D/d = \frac{1}{2\pi}\sqrt{\frac{\mu}{\epsilon}}\ \log D/d \qquad (6)$$

As is well known when the value of $D/d$ approaches 3.59, attenuation $\alpha$ approaches a mninimum and Z at minimum attenuation is approximately 77 ohms. Heretofore, it has been the practice to make some small coaxial cable having 50, 75, and 100 ohm impedances and having center conductors of 0.008, 0.010 and 0.010 inches diameter respectively. Such coaxial cables employing a Teflon dielectric require $D/d$ ratios of 2.3, 3.4 and 5.3 respectively when no magnetic loading is employed. Prior attempts to decrease the cable size without magnetic loading, increased the characteristic impedance and attenuation. Prior attempts to decrease attenuation were directed to an increase in inductance L and characteristic impedance Z through magnetic loading without a decrease in cable size.

Employing the present invention and maintaining the same center conductor as employed in the above mentioned prior art 50, 75 and 100 ohm coaxial cables, the *D/d* ratio of the new novel 50, 75 and 100 ohm coaxial cables may be reduced as follows: for 50 ohm cable *D/d* of 2.3 is reduced to 1.4, for 75 ohm cable D/d of 3.5 is reduced to 2.2 and for 100 ohm cable, *D/d* of 5.3 is reduced to 3.0 These figures are rounded representing a resultant or effective permeability $\mu_r$ of 5 and a dielectric constant $\epsilon$ for Teflon of 2.1.

It will be understood that the values of $\mu_r$ and $\epsilon$ may be changed and the desired impedance values of 50, 75 and 100 ohms maintained. As the D/d ratio is reduced and approaches unity the maximum values of $\mu_r$ required to achieve the desired impedance are obtained as follows: If $\epsilon$ is 1.6 as with foamed plastic, $\mu_r$ approaches 8.3 for 50 ohm cable; 23.4 for 75 ohm cable and 68.8 for 100 ohm cable. If $\epsilon$ is 2.1 as with Teflon $\mu_r$ approaches 11.2 for 50 ohm cable; 37.6 for 75 ohm cable and 126 for 100 ohm cable. Permalloy thin films, which are oriented by a magnetic field or by cold drawing, of the type employed are capable of achieving values of $\mu_r$ below and above five (the value employed for a preferred embodiment). Other magnetic thin film materials having the range of permeabilities described and having the abovementioned desired uniaxial circumferential orientation may be employed.

Reduction of the ratio of *D/d* while maintaining the impedance Z constant permits microminiature coaxial cable to be designed. The inside diameter D of the shield can now be reduced without increasing time delay or other losses which normally accompanied magnetic loading impedancce increases. Had the novel coaxial cable been available heretofore it could have been employed in aircraft and spacecraft electronics systems to decrease weight of the coaxial cables by up to fifty percent and further decrease the size and weight of the electronic hardware.

Figure 5:
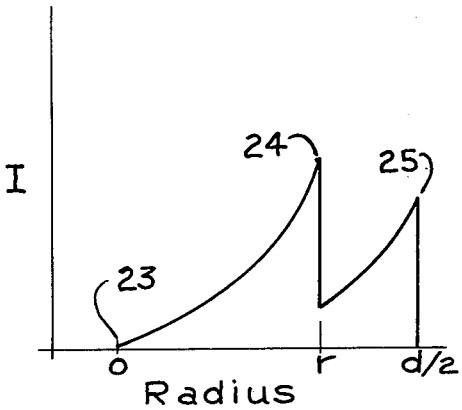
FIG. 5 is a schematic curve showing current density vs. distance from the center of a center conductor.

It is know that conventional current is displaced to the outside annular area of a conductor as frequency increases. FIG. 5 shows schematically how the current density increases exponentially toward the outer diameter of the center conductor 11. At the center 23, where the radius *r=o*, the current density is substantially zero at high frequency and rises to a maximum at the outer diameter 24 of the center conductor. Due to skin effect phenomenon the current density is believed to fall sharply at the boundary and increase exponentially again in the thin layer of magnetic material 12, rising to a maximum at the outside 25 of the magnetic material and then falling to zero. The skin depth thickness $\delta$ may be defined by the equation:

$$\delta = \sqrt{\frac{1}{\pi f \mu \sigma}} \qquad (7)$$

where $f$ is the frequency of operation, $\mu$ the maximum permeability of the conductor, and $\sigma$ is the conductivity. In a preferred embodiment, the skin depth thickness for the magnetic material and the copper conductor were estimated to be 0.62 microns and 4.6 microns thick respectively at 350 megahertz. The actual thickness of the magnetic layer was approximately 10,000 A or 1.0 micron. In the preferred embodiment explained hereinbefore the thin layer of magnetic material was thicker than the skin depth thickness. As frequencies increase the skin depth thickness will decrease, and if the thin layer of magnetic material is not reduced accordingly, attenuation of the electric field will result.

The thin layer of magnetic material 12 is preferably conductive and conductively attached to the center conductor 11 so that the radial electric field is continuous. When the electric field is continuous at the boundary, the conduction current is divided inversely proportional to the skin depth thicknesses of the two materials. It can be shown that highly conductive Permalloy having a small skin depth thickness will conduct a much larger amount of conduction current at high frequencies than the percentage increase in diameter of the center conductor. Since this phenomenon is true for one conductive layer of material having a different resistance, it is true for multiple layers of material having different resistances which are conductively connected or arranged in a continuous electric field to independently support conductive skin layers.

Not only does the thin layer of magnetic material conduct a portion of conventional current, but it enhances conduction of some form of wave energy. Without changing the conductivity of the magnetic material in a piece of novel cable, it was annealed partially destroying the circumferential orientation of the easy axis. As a result of the annealing the characteristic impedance $$Z_r = \sqrt{\frac{Lr}{C}}$$

increased which is attributed to an increase in aforementioned permeability $\mu$ and $\mu_r$, however, the time delay increased more than can be accounted for by any possible increase in permeability. The propagation of the wave energy is enhanced by the aforementioned circumferential orientation of the uniaxial anisotropic magnetic material. It may be possible that the partial annealing caused the shape of the B vs H curve to change, thus, the operation on a vertical slope region of the B vs H curve causes hysteresis losses, flux changes and time delays which did not occur when operating on a saturation portion of the curve of square loop material described in FIG. 4.

Figure 6:
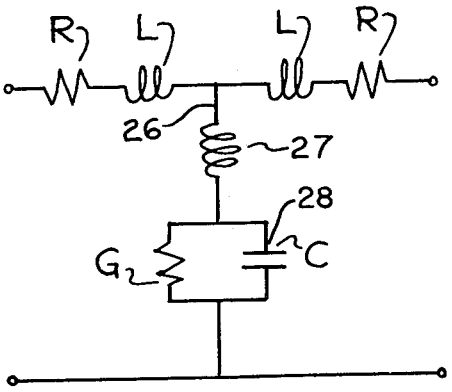
FIG. 6 is a simplified equivalent network circuit of the new coaxial cable.

Another explanation for the decrease in time delay T is made with reference to FIG. 6 showing a schematic network representation of the new coaxial cable. The shunt arm 26 of the equivalent Tee network was found to have an inductive reactance 27 in series with the shunt capacitance 28 which lowers the resonance point or cut off point compared to coaxial cables without the thin layer of magnetic material. At high frequencies above the cut off point, usually above twenty megahertz where fast rise time of sub nanosecond pulse power is operable, the inductive reactance 27 ($X_L$) is very large and tends to cancel out the capacitive reactance 28 ($X_C$). Above the cut off frequency the shunt arm 26 appears highly inductive so that the center conductor 11 is substantially isolated from the shield-return 13. When isolation occurs the time delay T is no longer equal to $\sqrt{LC}$ and the speed of propagation begins to approach the speed of light as is achieved in an open conductor, however, the skin effect losses and radiation losses which accompany open conductors have been reduced to those associated with standard coaxial cables.

Part of the current conducted in the layer of magnetic material may be forced into a helical path which helps to explain the increase in inductive reactance and the high magnetic field.

Another desirable feature of employing Permalloy Ni — Fe materials is to achieve reduced phase distortion. At high frequencies Permalloy acts as a magnetic damper providing a desirable roll off characteristic. This characteristic substantially attenuates the frequencies above the operating frequencies. which would otherwise provide phase distortion.

While this invention has been described with respect to particular embodiments employing a particular high anisotropy substantially circumferentially oriented magnetic material in film or solid core form, it is apparent that other magnetic materials can be found which have the desirable characteristic described hereinbefore. The coaxial transmission cable and method for reducing time delay and attenuation have been described as best available theoretical analysis will now permit. Other embodiments for reducing the size of coaxial cables for high frequency use without increasing time delay and attenuation will become apparent to those skilled in this art.

We claim:

1. The method of making flexible low time delay coaxial transmission cable comprising the steps of:

forming a magnetically loaded flexible center conductor having a layer of magnetic material having high conductivity, high permeability and high anisotropy, forming said layer of magnetic material to provide a circumferentially oriented easy axis of magnetization and a strong effective internal circumferential magnetic field, said step of forming said layer of magnetic material comprising the steps of heating said layer of magnetic material to near its recrystallization temperature and cooling said layer of magnetic material from near its recrystallization temperature while applying a conduction current through said center conductor, forming a flexible dielectric spacer layer around said magnetically loaded center conductor, and forming a flexible conductive shield completely around said dielectric spacer to provide flexible magnetically enhanced transmission cable with a permanent easy axis of magnetization oriented in a circumferentially direction.

2. A method of making flexible low time delay coaxial transmission cable as set forth in claim 1 wherein said strong effective circumferential magnetic field is provided by the step of simultaneously passing a conduction current through said center conductor while said magnetic layer is being formed.

3. A method of making flexible low time delay coaxial transmission cable as set forth in claim 1 which further includes heating said layer of magnetic material while forming said dielectric spacer around said coated center conductor.

4. The method of making flexible low time delay coaxial cable as set forth in claim 1 which further includes providing a very good electrically conductive center conductor having a layer of high permeability magnetic material on the outside, and the step of forming said layer of magnetic material to provide a circumferentially oriented easy axis of magnetization comprises the step of cold elongating said magnetically loaded center conductor.

5. The method of making flexible low time delay coaxial cable as set forth in claim 1 wherein the steps of forming a flexible center conductor and forming said layer of magnetic material on said center conductor comprise the step of plating a layer of high permeability magnetic material on the outside of a good electrically conductive center conductor while maintaining a constant conduction current in the center conductor sufficient to orient said magnetic material in a circumferential direction and further includes the steps of heating said layer of magnetic material when adding said dielectric layer and cooling said layer of magnetic material while a conduction current is being applied through said center conductor.

6. The method of making flexible low time delay coaxial transmission cable as set forth in claim 1 which further includes providing a crystalline grain structure magnetically loaded center conductor and said step of forming said layer of magnetic material includes elongating said magnetically loaded center conductor to form the axis of the crystalline grains in an axial and circumferential cross axial direction to provide said circumferentially oriented easy axis of magnetization.

7. The method of making flexible low time delay coaxial transmission cable as set forth in claim 6 wherein said step of forming said flexible dielectric layer around said magneticaly loaded center conductor comprises heating said center conductor near or to its recrystallization temperature, and further includes the step of providing a circumferential field in said center conductor while simultaneously cooling said dielectric layer and said center conductor.

8. The method of making flexible low time delay coaxial cable as set forth in claim 6 which further includes the step of forming a layer of very good electrically conductive material on the outside of said magnetically loaded center conductor to provide an electrical current path.

9. The method of making flexible low time delay coaxial cable as set forth in claim 7 wherein said step of providing a circumferential field in said center conductor comprises the step of maintaining a substantially constant current in said center conductor.

* * * * *